US007070515B1

(12) United States Patent
Liu

(10) Patent No.: US 7,070,515 B1
(45) Date of Patent: Jul. 4, 2006

(54) ADJUSTABLE GOLF PUTTER

(76) Inventor: Jui Feng Liu, 3F, No. 48, Lane 208, Wunde Rd., Neihu District, Taipei City 114 (TW)

( * ) Notice: Subject to any disclaimer, the term of this patent is extended or adjusted under 35 U.S.C. 154(b) by 0 days.

(21) Appl. No.: 11/030,913

(22) Filed: Jan. 10, 2005

(51) Int. Cl.
*A63B 53/02* (2006.01)

(52) U.S. Cl. ..... 473/340; 473/313; 473/334; 473/251; 473/255; 473/305

(58) Field of Classification Search ..... 473/244, 473/245, 246, 247, 248, 251, 255, 279, 290, 473/291, 305, 313, 314, 334, 340, 341, 349
See application file for complete search history.

(56) References Cited

U.S. PATENT DOCUMENTS 2,138,294 A * 11/1938 Douglas ..... 473/246
2,155,830 A * 4/1939 Howard ..... 473/246
2,882,253 A * 4/1959 Lefferdink et al. ..... 524/167
3,204,962 A * 9/1965 McCormick ..... 473/245
3,423,089 A * 1/1969 Andis ..... 473/245
5,749,790 A * 5/1998 Van Alen et al. ..... 473/245
5,997,409 A * 12/1999 Mattson ..... 473/244
6,001,024 A * 12/1999 Van Alen et al. ..... 473/244
6,435,976 B1 * 8/2002 Galliers ..... 473/244
6,692,371 B1 * 2/2004 Berish et al. ..... 473/244
6,723,000 B1 * 4/2004 Dombrowski ..... 473/239

* cited by examiner

*Primary Examiner*—William M. Pierce
(74) *Attorney, Agent, or Firm*—Rosenberg, Klein & Lee

(57) ABSTRACT

An adjustable golf putter includes a shaft and a head; the head being comprised of a putting part and an adjustment device connected to the back of the putting part; the adjustment device includes a base, a trough being disposed on the central section of the base to accommodate a roller; a sleeve and an adjustment mechanism being respectively inserted to both ends of the roller; a joint being adapted to the roller to be incorporated with the shaft; an insertion channel being each disposed in recess on both sides of the base; a threaded bolt being fixed in the insertion channel for the installation of weights and their positions by means of two sets of nuts to adjust the weight and central gravity of the head.

4 Claims, 8 Drawing Sheets

ADJUSTABLE GOLF PUTTER

BACKGROUND OF THE INVENTION (a) Field of the Invention

The present invention is related to a golf putter, and more particularly to an adjustable golf putter.

(b) Description of the Prior Art

Most of the golf clubs are each made in one-piece. That is, the grip, the shaft, and the head of a club, iron or wood, are fixed to compromise the specification. However, such a fixed construction often fails a golf player, professional or amateur, to achieve its best hitting status. Particularly when the golf ball is on the green, choosing a right putter could be a headache. Usually, the player would just grab one as desired. It's no way for a play to advance his playing skill. In the design of a putter, the primary concern is given to its specification including lie angle, off set, weight, and length. The lie angle determines whether the human body structure could be incorporated with the putter to put the ball into the hole by cashing out of the optimal pendulum effects. The offset is directly related to the direction the ball travels and thus affects the rolling route of the ball. The weight involves the size of the kinetic energy when the putter hits the ball. If affects most the rolling quality of the ball up or down the slope on the green. Should the putter be adapted with sufficient weight, the optimal stability is paid to the ball rolling on the green. Accordingly, if all those factors described above have been taken into considerations in the design of specification of a golf club, the player would have satisfactory performance on the course and on the green. However, those putters generally available on the market fail to meet those design requirements at the same time. A player is forced to have passive use of a putter without the option to adjust the putter in coping with his own particular needs. He just has to test one putter after another before deciding on one that is better meeting his own swinging habits and style. To a professional or an amateur, all he gets is an impractical answer to a question. Therefore, it is an urgent topic in the manufacturing industry of golf clubs to come up with a putter of a specification entirely suits the individual player.

SUMMARY OF THE INVENTION

The primary purpose of the present invention is to provide a putter with an adjustable head that makes easy and fast adjustment of active device of the putter for its offset, lie angle, and weight as desired by the player.

To achieve the purpose, the present invention includes a shaft and a head connect to the shaft. Wherein, the head includes a putting part and an active device connected to the back of the putting part. The active device includes a base, a concave arc part is provided on the center section of the base to accommodate a roller. A sleeve and an adjustment mechanism are respectively inserted to both ends of the roller. A hole is provided on the putting part for the installation of the sleeve, and the roller is connected with a joint to engage the shaft. Two channels are respectively provided on both sides of the base with each channel being fixed with a bolt therein for the installation of one or a plurality of weight and two nuts. The gravity center and the weight of the head are adjusted by the location and the quantity of the weight.

DETAILED DESCRIPTION OF THE PREFERRED EMBODIMENTS

Figure 1:
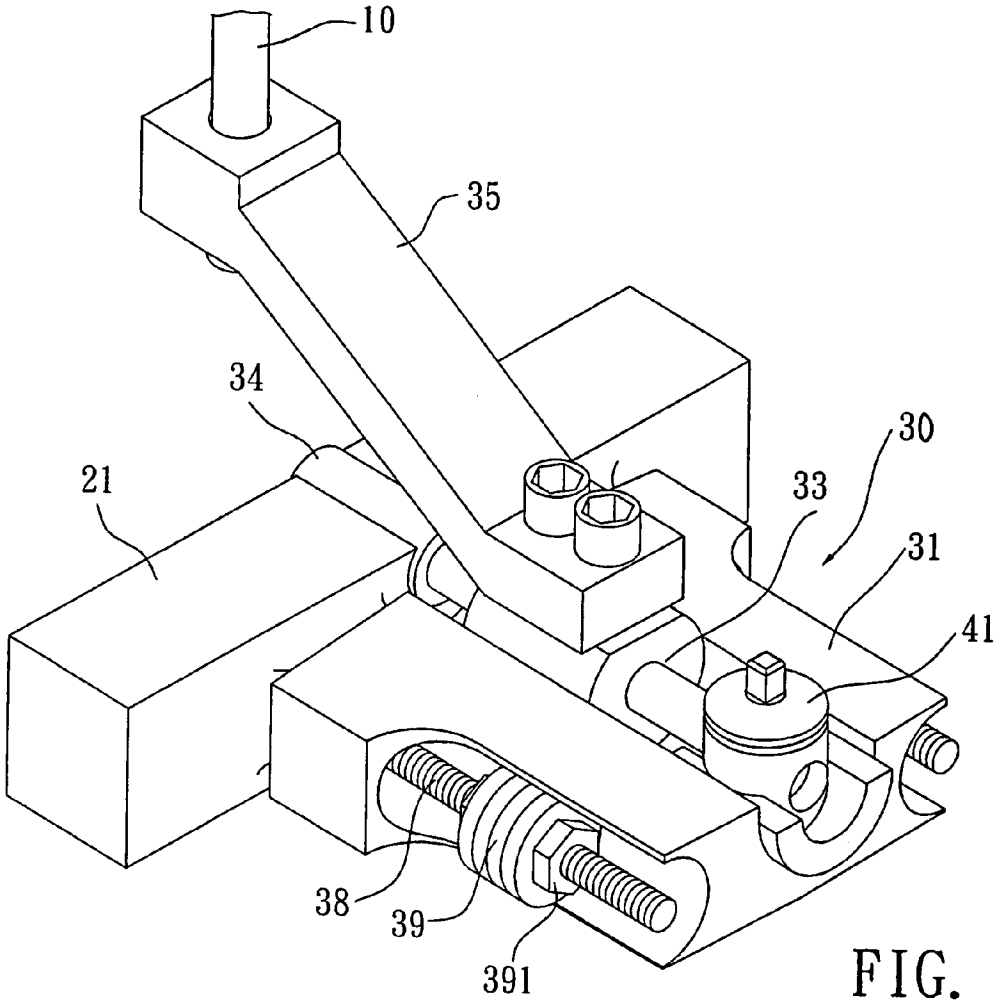
FIG. 1 is a perspective view of the present invention.
Figure 2:
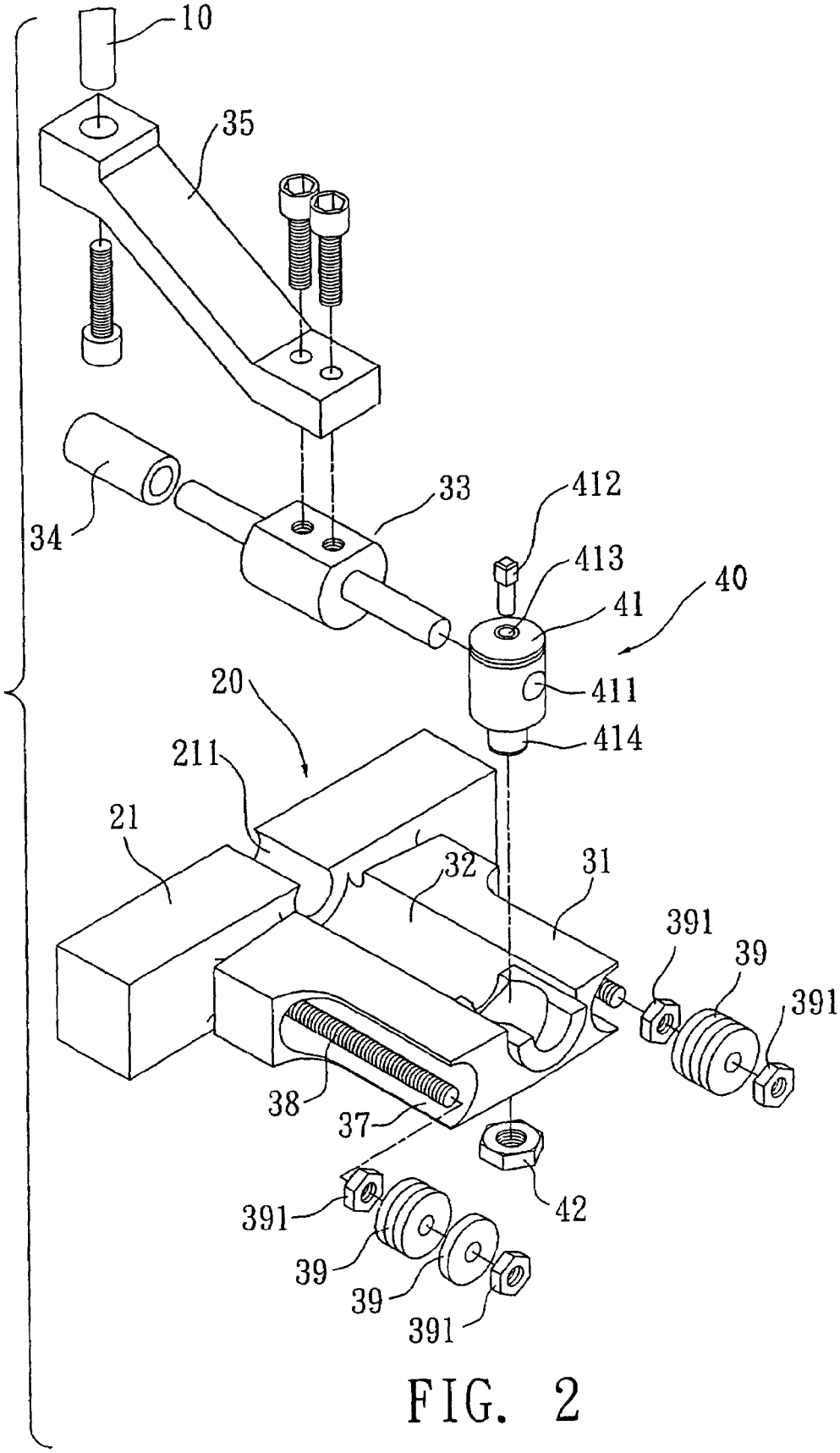
FIG. 2 is an exploded view of the present invention.

Referring to FIGS. 1 through 8, a preferred embodiment of the present invention includes a shaft 10 and a head 20 connected to the shaft. The head 20 includes a putting part 21 and an active device 30 connected to the back of the putting part. The active part 30 includes a base 31 and a trough 32 is provided on the center section of the base 31 to accommodate the installation of a roller 33. Both ends of the roller 33 are respectively inserted into a sleeve 34 and an adjustment mechanism 40. A channel 211 is provided on the putting part for the sleeve 34 to rest upon it. The roller 33 is connected to a joint 35 to link to the shaft 10. One insertion channel 37 is each provided on both sides of the trough 32, and each insertion channel 37 is fixed with a bolt 38 therein to be inserted with multiple weights 39 and two nuts 391 for adjusting the position of the center of gravity by adjusting the position of the weights.

Figure 3:
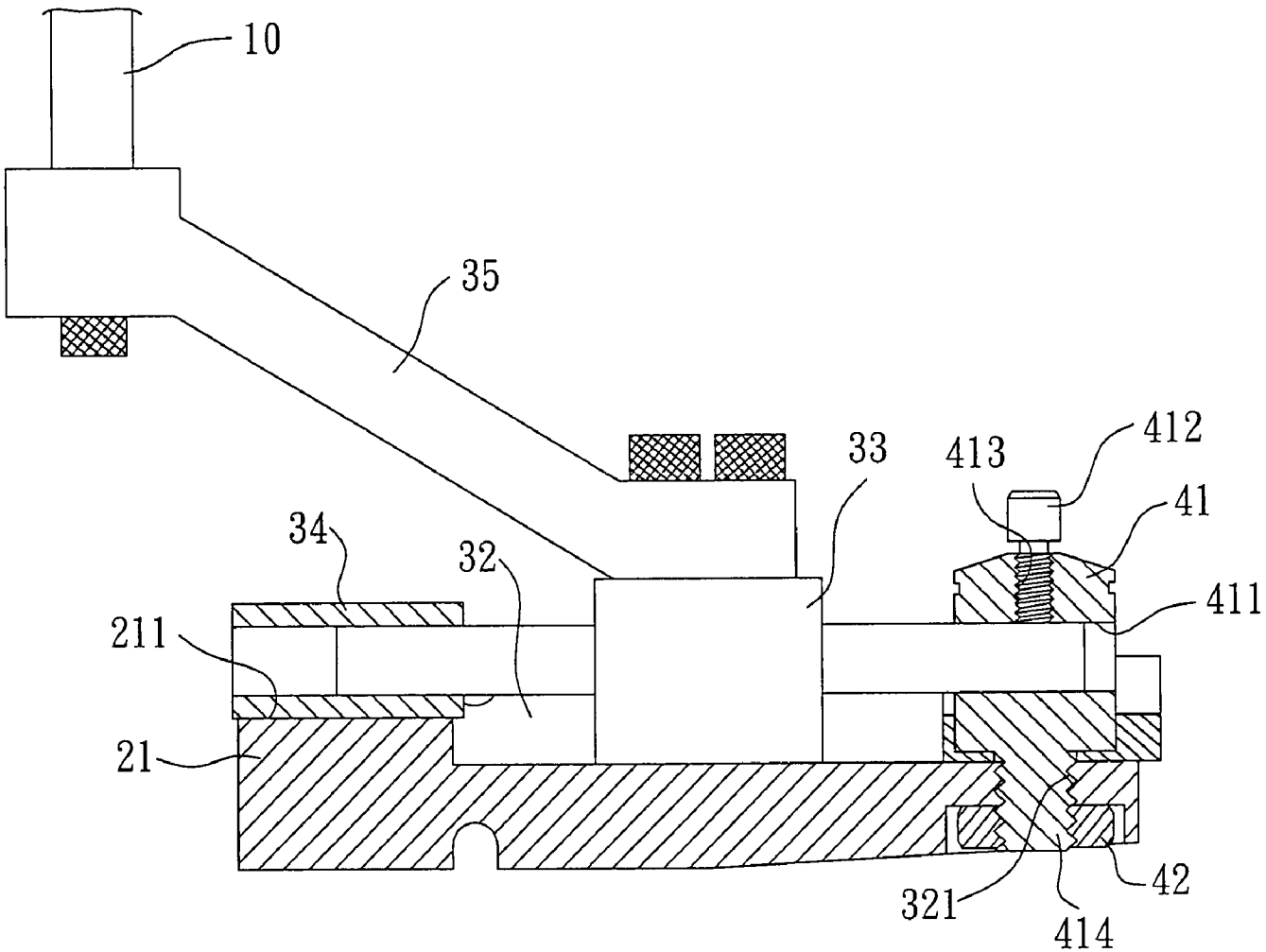
FIG. 3 is a sectional view of the present invention.
Figure 4:
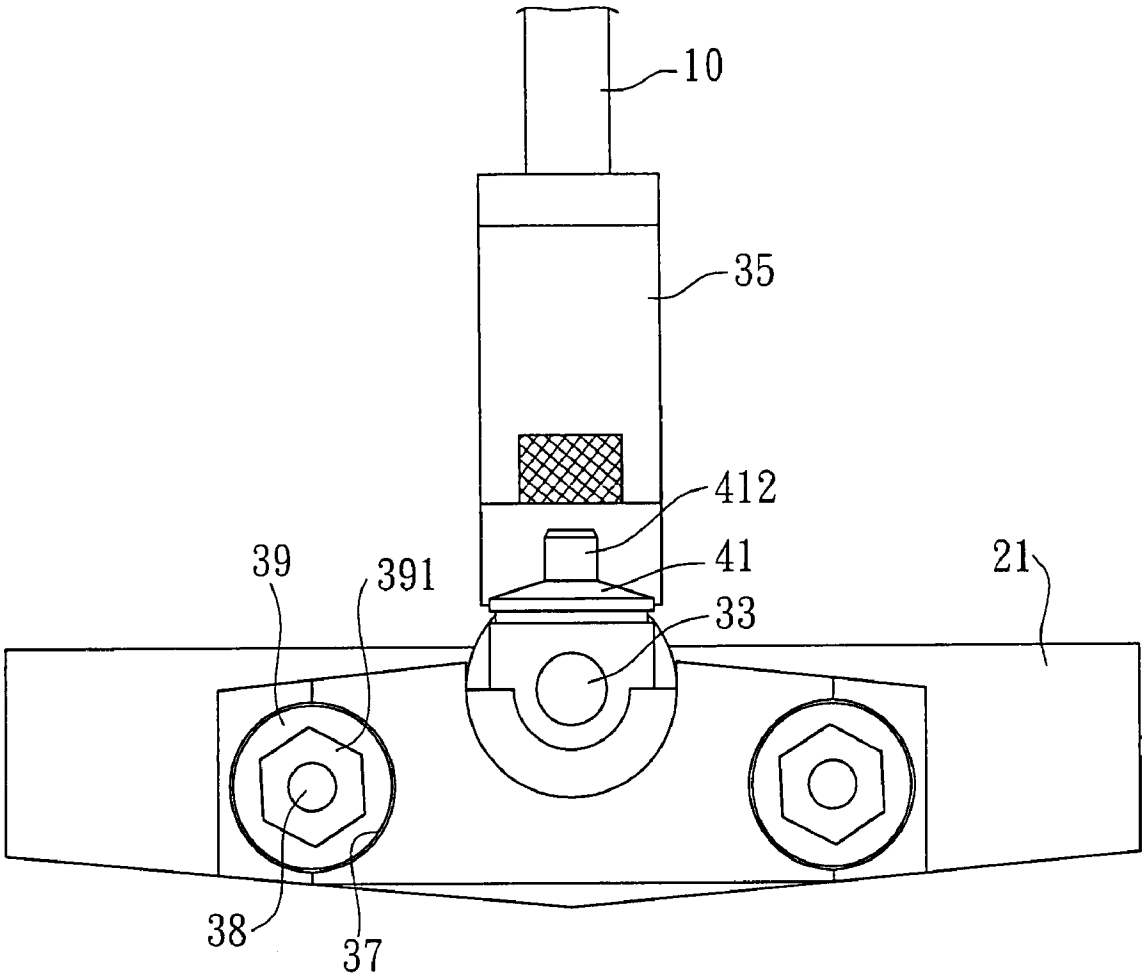
FIG. 4 is a front view of the present invention.
Figure 5:
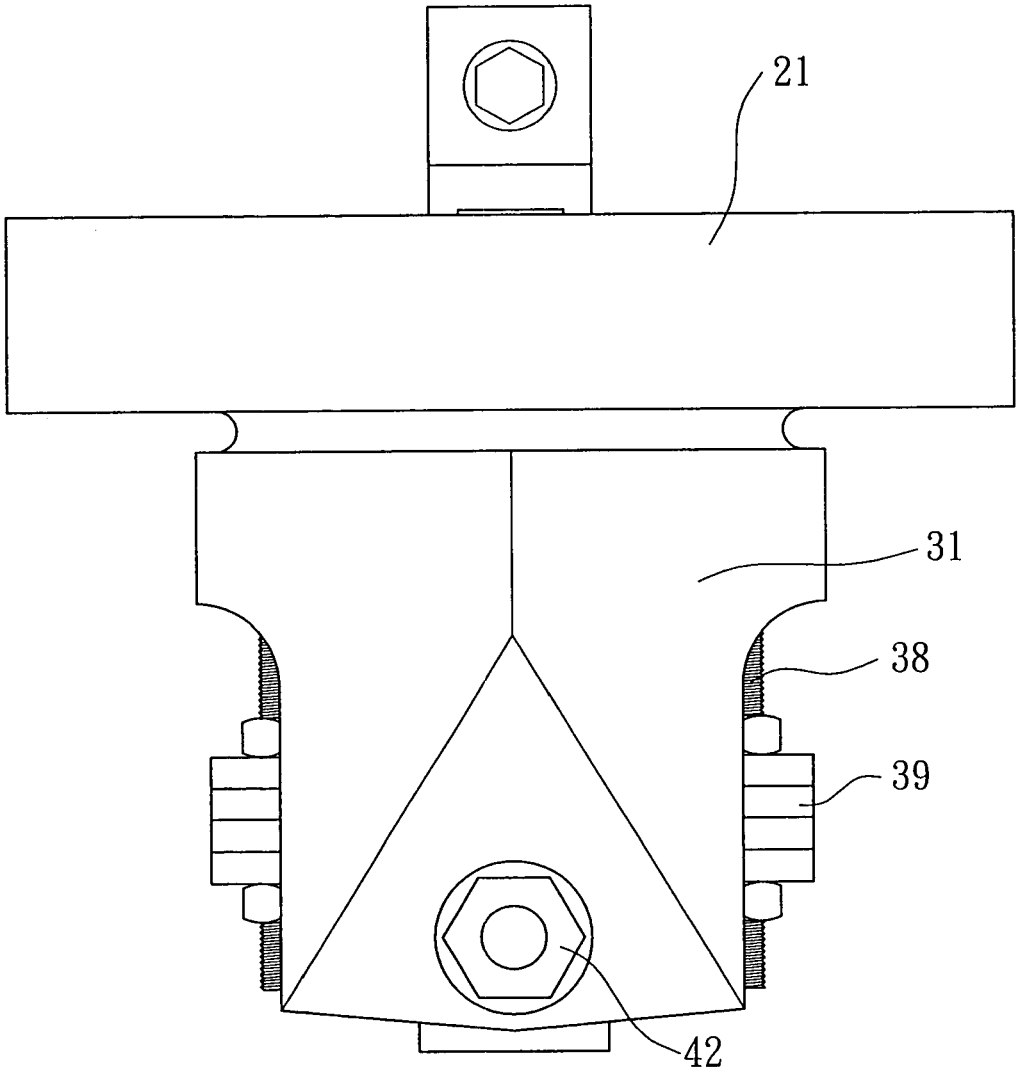
FIG. 5 is a bottom view of the present invention.

A notch 321 is provided to the trough 32 on the base 31 on the distal end of the putting part 21 for incorporation to the adjustment mechanism as illustrated in FIG. 3. The adjustment mechanism contains an adjustment block 41 and a through hole 411 is provided on the adjustment block 41 at where in relation to the roller 33. The adjustment block 41 is axially disposed with a screwed hole 413 for an adjustment rod 412 (i.e., a bolt in the preferred embodiment) to engage into the screwed hole 413 to push against and secure the roller 33 in position. A threaded part 414 extends from the bottom of the adjustment block 41 to be engaged to and secured in the notch 321 of the trough 32 with a nut 42.

Figure 6:
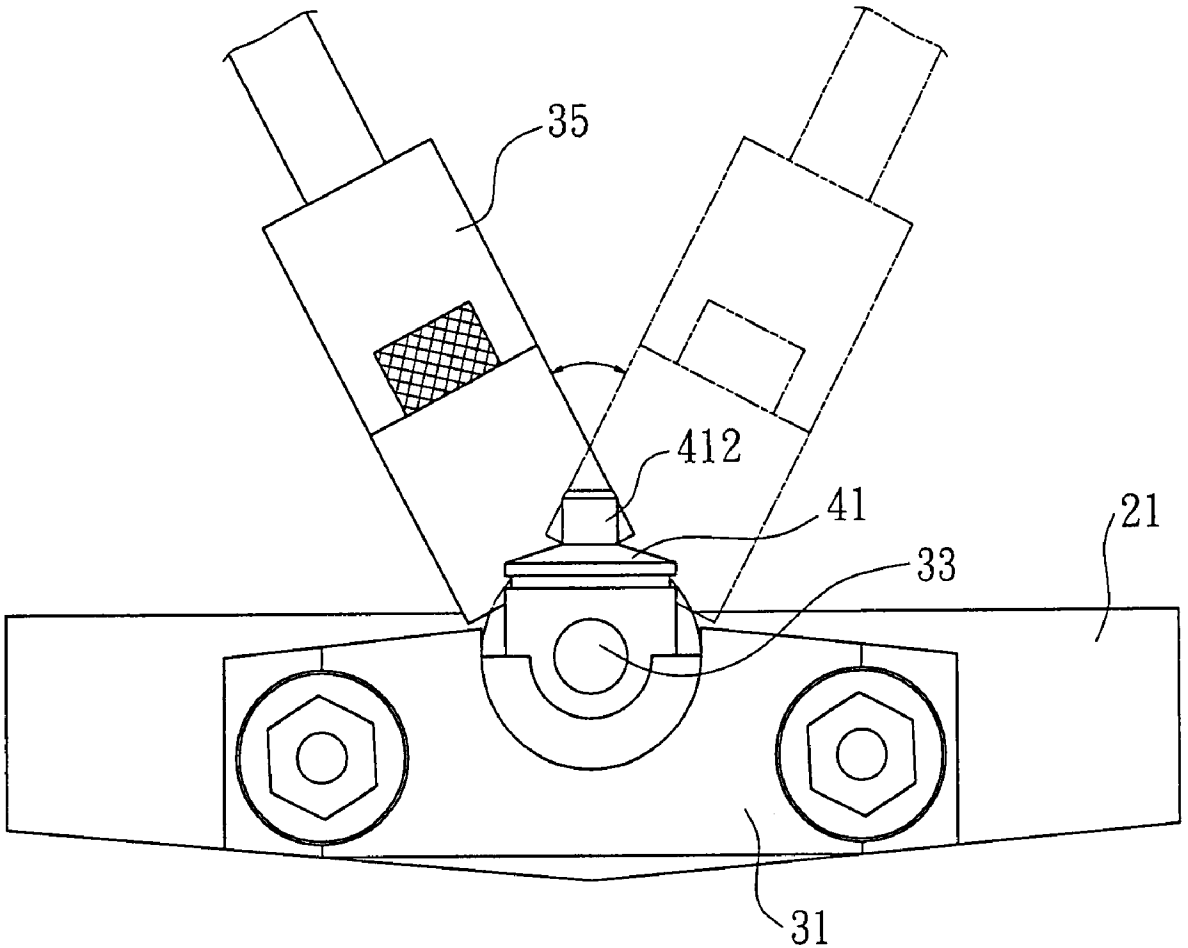
FIG. 6 is a schematic view showing lie angle adjustment by the present invention.

Now referring to FIG. 6 for a schematic view showing the adjustment of the lie angle, the adjustment rod (the bolt) 412 at the top of the adjustment mechanism 40 is released in the notch 413 for the roller 33 to adjust the lie angle in the trough 32 of the base 31.

By turning the roller 33, the lie angle between the shaft 10 and the putting part 21 is adjusted. When the roller 33 is turned clockwise, the lie angle is increased; or counter-clockwise, decreased. Upon completing the adjustment of the lie angle, the adjustment rod (the bolt) 412 is tightened once again to push against and secure the roller 33 in position. Accordingly, the human body is incorporated to the entire putter to achieve the optimal pendulum effects to put the ball into the hole.

Figure 7:
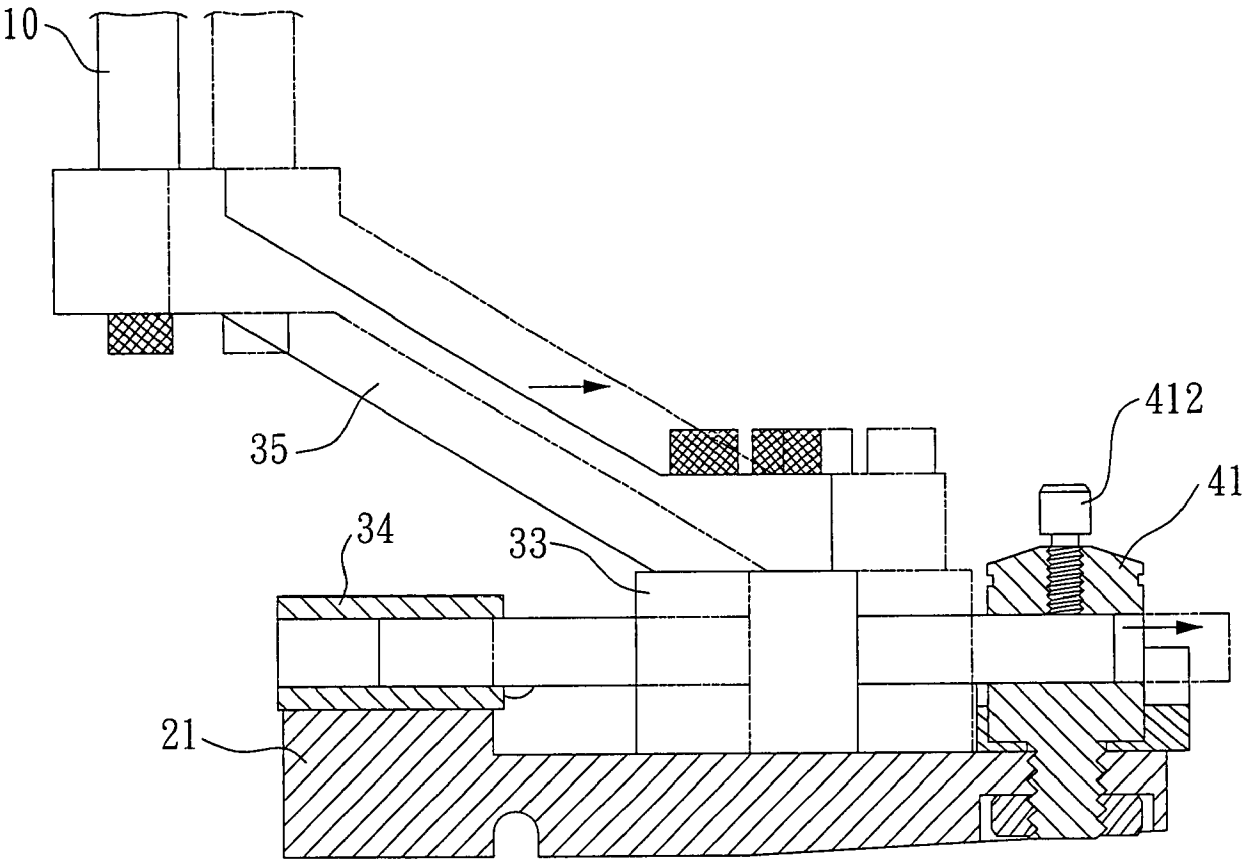
FIG. 7 is a schematic view showing offset adjustment by the present invention.

FIG. 7 shows a schematic view of the adjustment of the offset.

While putting the ball using a putter, the extent of the force applied would cause the ball to defect to either right or left to the assumed route toward the hole. In such case, the offset can be corrected by adjusting the range of the roller 33. In doing so, the adjustment rod (the bolt) 412 is released in the notch 413 of the adjustment block 41 to advance or retreat the roller 33 in the notch trough 32 of the base 31. If the route is deflected to its right due to that the timing to hit the ball varies, the offset should be increased to correct by moving the roller backward. On the contrary, if the route tends to be deflected to the left, simply by slightly advancing the roller. Upon completing the adjustment, the adjustment rod (the bolt) 412 is tightened once again to push against and secure the roller in position.

Figure 8:
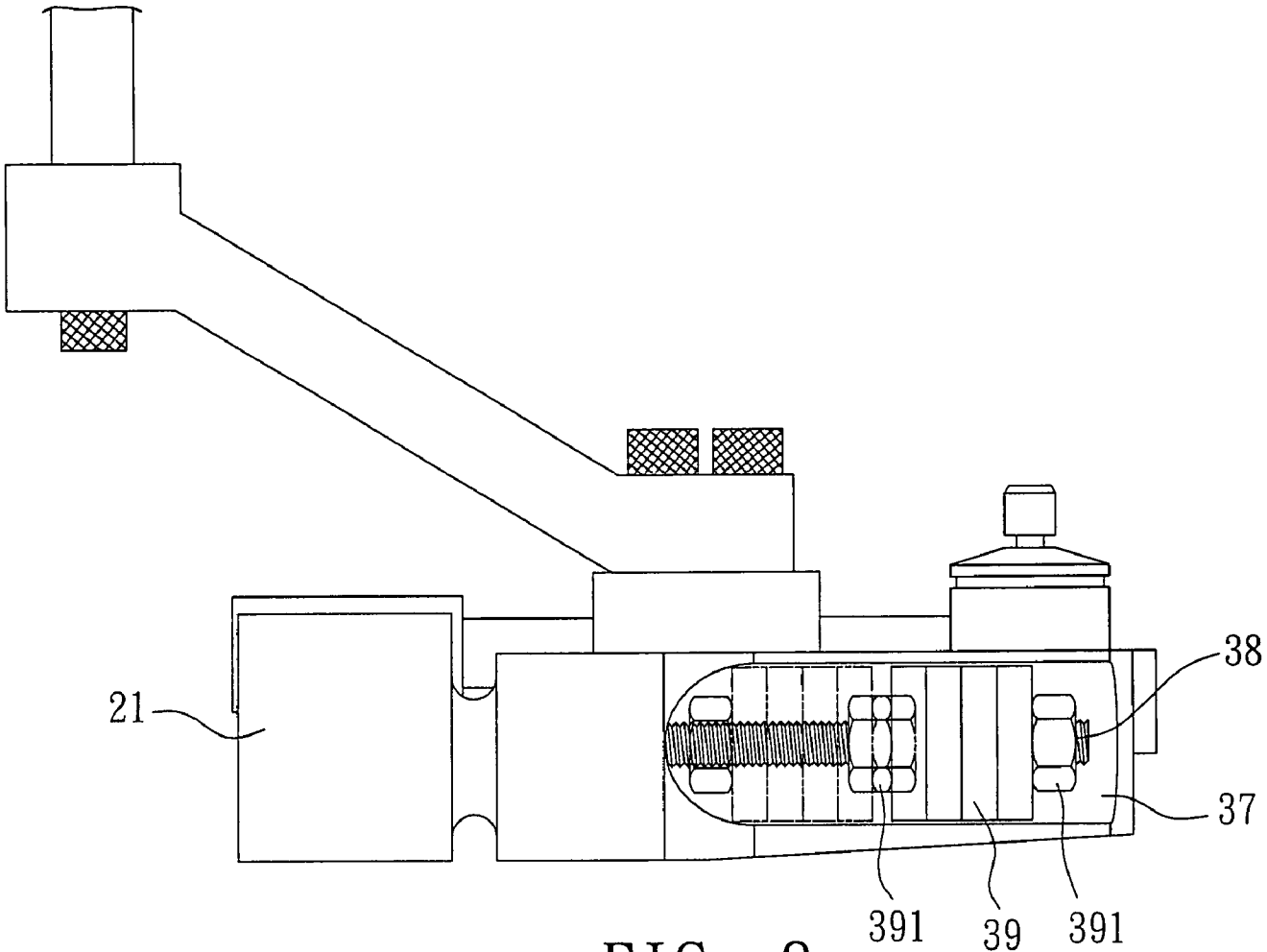
FIG. 8 is a schematic view showing weight adjustment of the present invention.

The present invention achieves the purpose of adjusting its center of gravity and weights. When the putter hits the ball, the extent of the kinetic energy applied in the hitting is sufficient to affect the stability of the rolling ball, particularly so true when putting on a slope on the green. Therefore, the ball rolling on the green would be subject to less jotting applied with the same force when supported by sufficient weights and proper center of gravity of the putter. On the contrary, the insufficient kinetic energy would subject the ball to be checked by the green, resulting in abnormal jotting. Therefore, those multiple weights 39 provided to the bolt 38 of the base 31 can be adjusted for their positions by means of two nuts 391. As illustrated in FIG. 8, the weight can be changed by either increasing or reducing the number of the weights 39 so to adjust for the optimal center of gravity and weight for the entire head 20 anytime and anywhere.

It can be appreciated that many other preferred embodiments are possible simply by having changes in certain details. For example, the adjustment rod is made in a form of a pin to be inserted into the notch in the adjustment block to push against the roller for adjustment and restriction to achieve the same purposes sought by the present invention.

I claim:

1. An adjustable golf putter comprising a shaft and a head connected to the shaft; the head containing an active device connected to the back of the putting part; the active device including a base provided at its central section a trough to accommodate a roller; both ends of the roller being respectively inserted into a sleeve and an adjustment mechanism; the putting part being provided with a channel for the sleeve to rest on; the roller being connected to a joint for incorporating to the shaft; one insertion channel being each provided on both sides of the base; a bolt being fixed in each insertion channel, one or a plurality of weight and two nuts being installed thereon; and the center of gravity and the weight of the head being adjusted by the position and quantity of the weights.

2. The adjustable golf putter of claim 1, wherein the trough defines an arc shape and has a notch disposed at its distal end from the putting part for receiving insertion for combination by the adjustment mechanism.

3. The adjustable golf putter of claim 1 or claim 2, wherein an adjustment block is provided to the adjustment mechanism; a through hole being disposed to the adjustment block at where in relation to the roller; a screwed hole being provided axially of the adjustment block; the screwed hole being inserted with an adjustment rod to push against and secure the roller in position; a screwed part extending from the bottom of the adjustment block; and the screwed part being fastened with a nut in the notch in the trough.

4. The adjustable golf putter of claim 1 or claim 2, wherein the adjustment rod relates to a pin; and the pin is inserted into the insertion hole of the adjustment block to push against and limit the movement of the roller.

* * * * *